US008864636B1

(12) United States Patent
Danowski et al.

(10) Patent No.: US 8,864,636 B1
(45) Date of Patent: Oct. 21, 2014

(54) ADJUSTMENT MECHANISM FOR VACUUM LOAD RESISTANCE TRAINING EXERCISE APPARATUS

(75) Inventors: Thomas J. Danowski, Schaumburg, IL (US); Lee M. Atwood, Andover, MN (US)

(73) Assignee: Brunswick Corporation, Lake Forest, IL (US)

( * ) Notice: Subject to any disclaimer, the term of this patent is extended or adjusted under 35 U.S.C. 154(b) by 661 days.

(21) Appl. No.: 13/087,980

(22) Filed: Apr. 15, 2011

(51) Int. Cl.
*A63B 21/00* (2006.01)

(52) U.S. Cl.
USPC ..... 482/112; 482/99; 482/93

(58) Field of Classification Search
USPC ..... 482/112, 92, 11, 99, 100, 93, 98, 102
See application file for complete search history.

(56) References Cited

U.S. PATENT DOCUMENTS

| | | | | |
|---|---|---|---|---|
| 4,426,077 | A * | 1/1984 | Becker | 482/92 |
| 4,854,574 | A | 8/1989 | Larson et al. | |
| 5,044,631 | A | 9/1991 | Jones | |
| 7,811,214 | B1 | 10/2010 | Danowski | |
| 2006/0084555 | A1 * | 4/2006 | Garner | 482/112 |
| 2007/0105695 | A1 * | 5/2007 | Susta | 482/92 |
| 2007/0129223 | A1 * | 6/2007 | Kolomeir | 482/112 |

* cited by examiner

*Primary Examiner* — Jerome W Donnelly
(74) *Attorney, Agent, or Firm* — Andrus Intellectual Property Law, LLP

(57) ABSTRACT

Resistance training exercise apparatus provides load resistance with a vacuum load assembly, and has an adjustment mechanism controlling effective vector force between the vacuum load assembly and a user-engaged exercise member. The adjustment mechanism includes a user-controlled adjustment assembly adjustably varying the vector force. The adjustment assembly includes a coupling mechanism adjustably varying a lever arm distance of at least one of a gym cable and a cylinder cable along the adjustment assembly.

27 Claims, 7 Drawing Sheets

ADJUSTMENT MECHANISM FOR VACUUM LOAD RESISTANCE TRAINING EXERCISE APPARATUS

BACKGROUND AND SUMMARY

The invention relates to resistance training exercise apparatus.

Various types of resistance training exercise apparatus are known in the prior art, including load systems for providing resistance.

Commonly owned co-pending U.S. patent application Ser. No. 12/854,279, filed Aug. 11, 2010, is directed to resistance training exercise apparatus with a vacuum load system.

The present invention arose during continuing development efforts in the above technology.

BRIEF DESCRIPTION OF THE DRAWINGS

FIG. 1 is a perspective view of resistance training exercise apparatus in accordance with the '279 disclosure.

FIG. 2 is a sectional view of a portion of FIG. 1.

FIG. 3 is like FIG. 2 and shows another embodiment.

FIG. 4 is like FIG. 2 and shows another embodiment.

FIG. 5 is like FIG. 2 and shows another embodiment.

DETAILED DESCRIPTION

The following description regarding FIGS. 1-5 is taken from the noted commonly owned co-pending U.S. patent application Ser. No. 12/854,279, filed Aug. 11, 2010.

Figure 1:
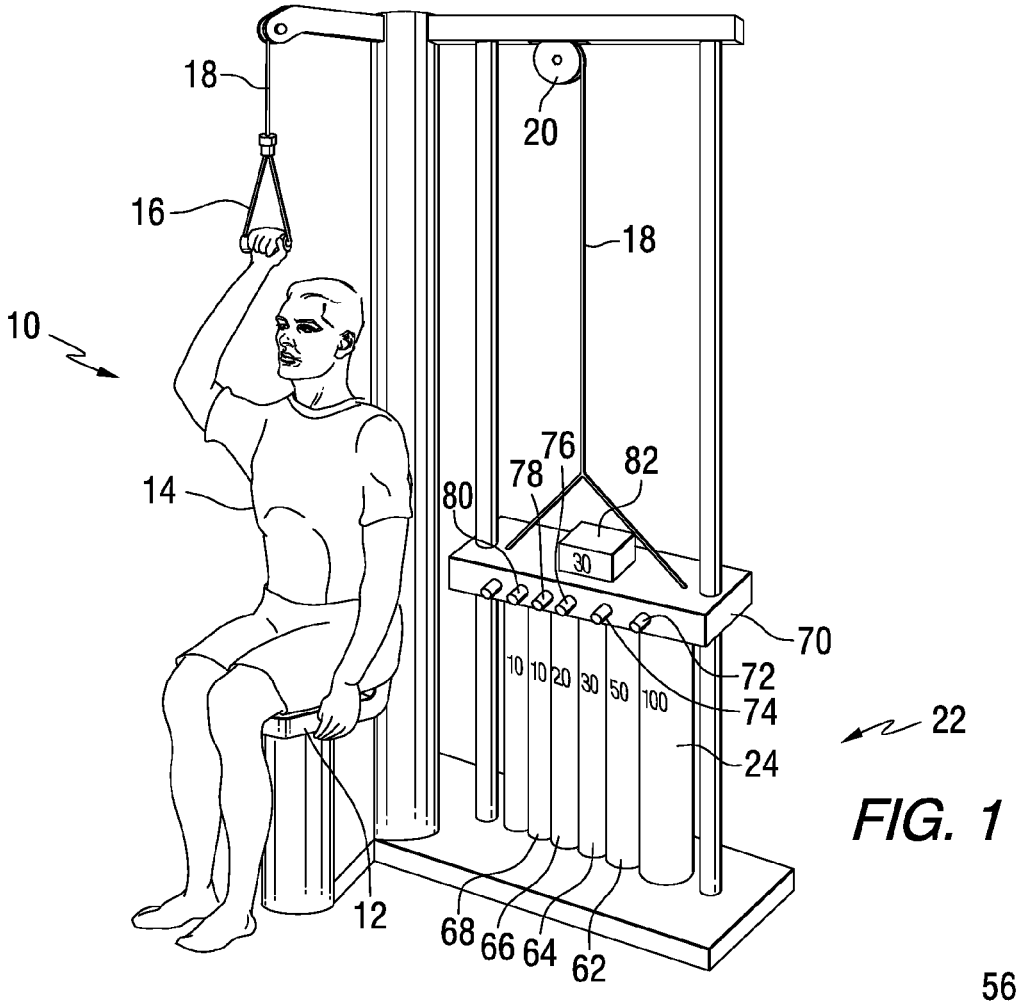
FIGS. 1-5 are taken from commonly owned co-pending U.S. patent application Ser. No. 12/854,279.

FIG. 1 shows resistance training exercise apparatus 10 including a seat 12 for supporting a seated user 14 and having a handle 16 for gripping by the user and connected through a cable 18 and pulley system 20 to a load system for providing resistance, as is known.

Figure 2:
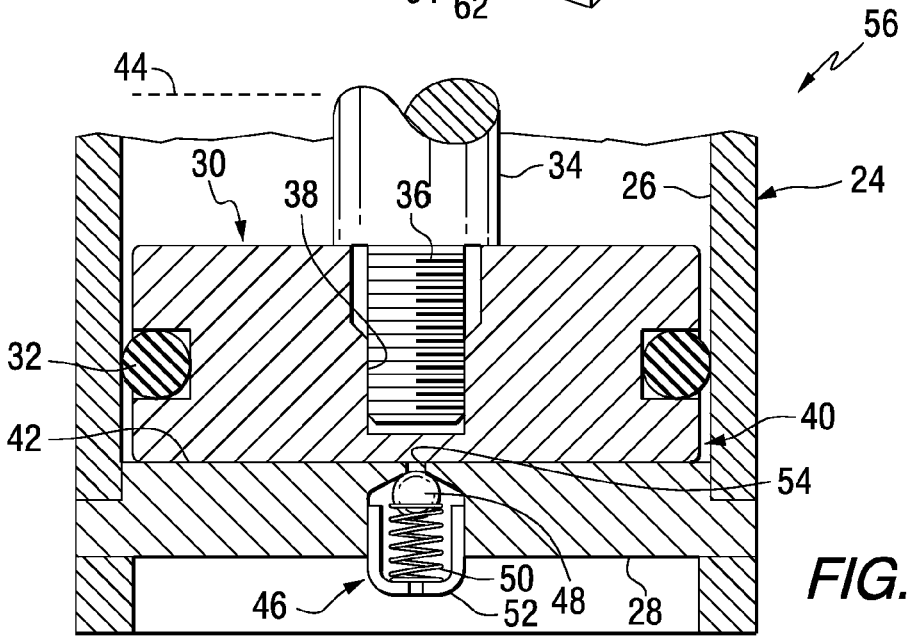
Figure 3:
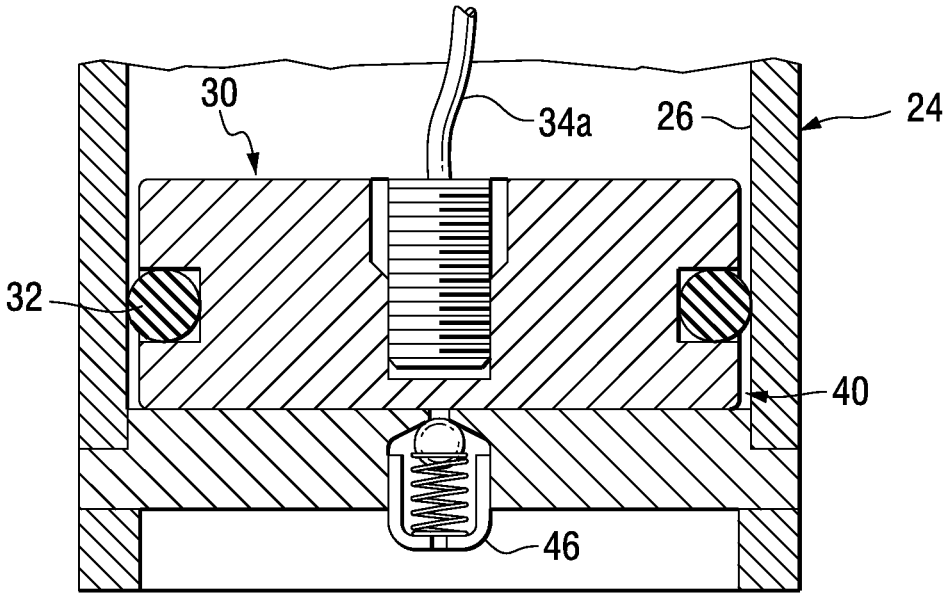
Figure 4:
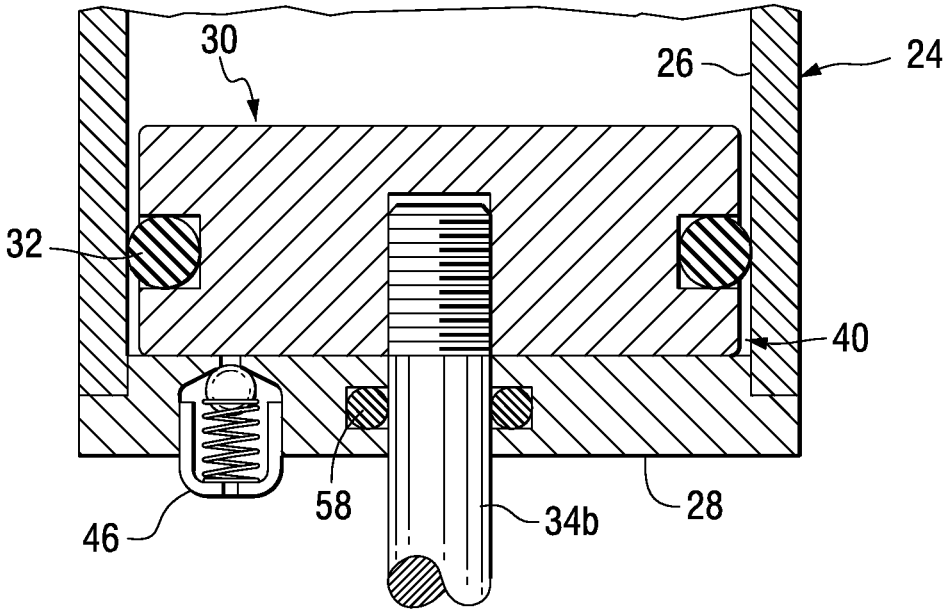

The system of the '279 application provides a load system 22 including an axially extending tubular housing 24, FIGS. 1, 2, having an inner cylinder wall 26 extending axially from an axial end wall 28. A piston 30 in the housing engages cylinder wall 26 in sealing relation and is axially slidable therealong, e.g. up-down in FIG. 2. An O-ring 32 may provide a seal, or other types of rings may be used or multiple rings may be used or a cup seal may be provided on each side of the piston or in another embodiment no sealing ring or gasket is used and instead a flush fit between the piston and the cylinder wall is relied upon for sealing purposes. A connector link 34, e.g. a rigid piston rod or other rod or a flexible cable 34*a*, FIG. 3, extends from piston 30 and is coupled to user-engaged exercise member 16, e.g. through the noted cable and pulley system 18, 20. Rod 34 is secured to piston 30 in any suitable manner, e.g. by being threaded thereinto as shown at threads 36 of rod 34 threaded into threaded bore 38 of piston 30. Piston 30 defines a chamber 40 in housing 24 between piston 30 and end wall 28. FIG. 2 shows the volume of such chamber 40 being at a minimum, in one embodiment substantially zero, with piston 30 touching end wall 28. Though the noted volume will never be perfectly zero, because there is always some volume at 40, the noted one embodiment provides substantially zero volume to minimize the relative amount of free space that will need to be expanded to create vacuum. Piston 30 is movable in a first axial direction (upwardly in FIG. 2) away from end wall 28 to increase the volume of chamber 40, whereafter piston 30 is movable in a second opposite axial direction (downwardly in FIG. 2) toward end wall 28 to decrease the volume of chamber 40. Movement of piston 30 in the noted first axial direction (upwardly in FIG. 2) creates vacuum in chamber 40. This vacuum provides load resistance resisting exercise movement of user-engaged exercise member 16, e.g. resisting downward and/or outward leftward movement of member 16 in FIG. 1.

Piston 30 has an axial travel stroke (up-down in FIG. 2) between a rest position as shown in solid line at 42, and a loaded position as shown in dashed line at 44. Piston 30 moves in the noted first axial direction (upwardly) from the rest position to the loaded position and is resisted by vacuum load resistance due to the vacuum created in chamber 40. Such vacuum urges piston 30 to move in a second axial direction (downwardly in FIG. 2) to return to the rest position from the loaded position. Housing 24 is open to atmosphere at its top, and accordingly atmospheric pressure is applied to the upper surface of piston 30, while vacuum is applied to the lower surface of piston 30 upon upward movement of the piston as pulled upwardly by rod 34 coupled to cable 18. In one embodiment, chamber 40 is selected to minimize the volume of such chamber when piston 30 is in its lowered rest position, to minimize the relative amount of free space that will need to be expanded to create the noted vacuum. Further in such embodiment, the volume of chamber 40 is substantially zero when piston 30 is in its rest position 42.

In one embodiment, chamber 40 has a one-way valve 46, FIG. 2, blocking ingress of air into chamber 40 and permitting egress of air from chamber 40. This accommodates leakage of air past piston 30 into chamber 40 and permits expulsion of such leakage air from chamber 40 downwardly through valve 46 upon downward movement of piston 30 in the noted second axial direction (downwardly in FIG. 2). This facilitates movement of piston 30 to its rest position at 42 and maintains minimized free space in chamber 40 that will need to be expanded to create the noted vacuum. One-way valve 46 may be a check valve having a ball 48 biased by spring 50 bearing against cage 52 and biasing ball 48 upwardly against valve seat 54.

User-engaged exercise member 16 is movable in at least two opposite exercise directions, e.g. downwardly and upwardly in FIG. 1. Load system 22 provides load in both directions of exercise movement of user-engaged exercise member 16. Load system 22 provides load in a first direction of exercise movement of user-engaged exercise member 16 (e.g. downwardly in FIG. 1) corresponding to the noted first direction of piston movement (upwardly in FIG. 2). Load system 22 provides load in a second opposite direction of exercise movement of user-engaged exercise member 16 (e.g. upwardly in FIG. 1) corresponding to the noted second direction of piston movement (downwardly in FIG. 2). Vacuum load 22 thus simulates a weight stack relying upon gravity to provide load in both directions of exercise movement of user-engaged exercise member 16. The first direction of exercise movement of user-engaged exercise member 16 (downwardly in FIG. 1) applies a first direction force on piston 30 (an upwardly directed pulling force in FIG. 2) which is resisted by the noted vacuum created in chamber 40. The noted vacuum applies a second opposite direction force on piston 30 (a downwardly directed force in FIG. 2) urging piston 30 to return to its rest position at 42 and urging user-engaged exercise member 16 in the noted second opposite direction of movement thereof (upwardly in FIG. 1).

In the embodiment of FIG. 2, rod 34 is axially extensible out of and retractable into housing 24 at an axial end 56 of the housing distally opposite end wall 28. In another embodiment, rod 34*b*, FIG. 4, extends axially through end wall 28 and is axially extensible out of and retractable into the housing at end wall 28 in axial sealing sliding relation, and may include a sealing O-ring 58.

In further embodiments, the load system includes a plurality of axially extending tubular housings as shown in FIG. 1 at 24, 62, 64, 66, 68, and so on, each housing having an inner cylinder wall, e.g. 26, FIG. 2, extending axially from an axial end wall 28. A plurality of pistons such as 30 are provided, one in each of the noted housings and engaging a respective cylinder wall in sealing relation and axially slidable therealong. A plurality of connector links such as 34 are provided, each extending from a respective piston 30 and couplable to a user-engaged exercise member 16 through a coupler bar 70 and the noted cable and pulley system 18, 20. Each piston defines a chamber such as 40 in its respective housing between the respective piston 30 and the respective end wall 28, as above. Each piston is movable in a first axial direction (e.g. upwardly in FIG. 2) away from the respective end wall 28 to increase the volume of the respective chamber 40. Each piston is movable in a second opposite axial direction (downwardly in FIG. 2) toward the respective end wall 28 to decrease the volume of the respective chamber 40. Movement of each piston in the noted first axial direction (upwardly in FIG. 2) creates vacuum in the respective chamber 40 of the respective housing, which vacuum provides load resistance resisting movement of the coupled user-engaged exercise member 16 coupled through coupler bar 70 to the respective connector link provided by rod 34. A plurality of push-pull pins such as 72, 74, 76, 78, 80 and so on, are provided, one for each of the noted rods such as 34. Each push-pull pin is user-actuatable, e.g. by pushing in or pulling out, to engage and disengage a respective rod 34 to select which rods are coupled to coupler bar 70. The cumulative vacuum load is determined by the number of rods engaged and coupled to coupler bar 70.

In various embodiments, the plurality of the noted housings include a subset of a plurality of housings providing different vacuum loads, e.g. housing 24 providing a 100 lb. vacuum load, housing 62 providing a 50 lb. vacuum load, housing 68 providing a 10 lb. vacuum load, and so on. Also in various embodiments, the plurality of noted housings includes another subset of a plurality of housings providing the same vacuum load, e.g. housing 64 providing a 20 lb. vacuum load and housing 66 providing a 20 lb. vacuum load. This offers the user selectivity in choosing the load desired by simply engaging or disengaging the rod 34 of a selected housing at the respective push-pull pin. In various embodiments, the push-pull pins may have magnets on their ends which can interact with Hall effect sensors or switches in a circuit which adds the cumulative load selected and then displays the total load on a display such as a liquid crystal display 82. In further embodiments, such circuit may be powered by a solar cell.

In one embodiment, a 100 lb. load housing is provided by its piston 30 having an area of 6.80 sq. in., a radius 1.47 in., and a diameter of 2.94 in., and a 50 lb. load housing is provided by its piston 30 having an area of 3.40 sq. in., a radius of 1.04 in., and a diameter of 2.08 in., and a 20 lb. load housing is provided by its piston 30 having an area of 1.36 sq. in., a radius of 0.65 in., and a diameter of 1.131 in., and a 10 lb. load housing is provided by its piston having an area of 0.68 sq. in., a radius of 0.46 in., and a diameter of 0.93 in. Further in various embodiments, the system enables low overall pressure requirements such as 15 lb. per sq. in. maximum, and accordingly the housings such as 24 may be manufactured using plastic or other low cost material, including for cylinder walls 26.

Figure 5:
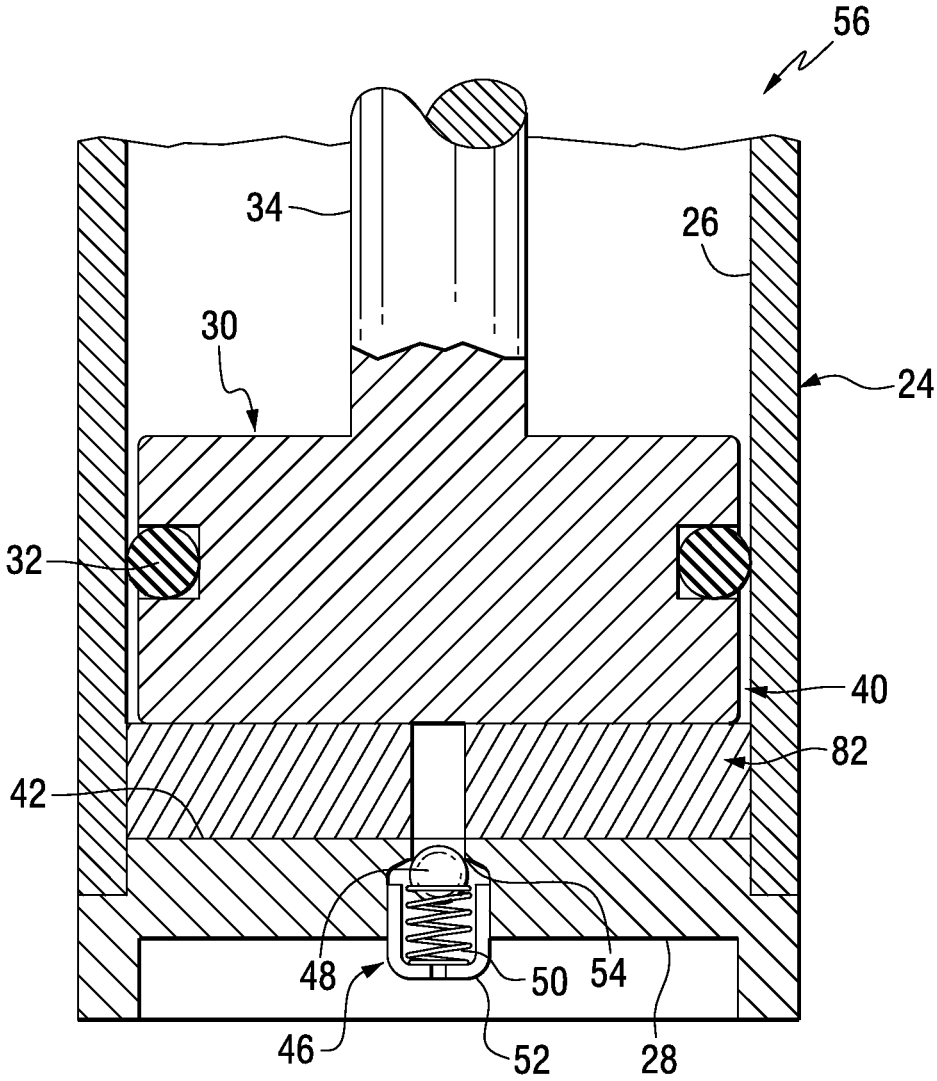

FIG. 5 shows another embodiment and uses like reference numerals from above where appropriate to facilitate understanding. A bumper member 82 is provided in housing 24 and is disposed axially between piston 30 and end wall 28. Bumper member 82 dampens impact of piston 30 against end wall 28 upon movement of the piston in the noted second axial direction (downwardly in FIGS. 2, 5). This prevents the piston from smashing into the end wall should the load be released by user 14, which may otherwise allow the piston to slam back downwardly against end wall 28. The bumper dampens the impact of such piston movement should the user let go of the load. In one embodiment, bumper member 82 is composed of resilient material, e.g. rubber.

FIGS. 6-15 show various embodiments of adjustment mechanisms for the noted vacuum load system, and use like reference numerals from above where appropriate to facilitate understanding.

Figure 6:
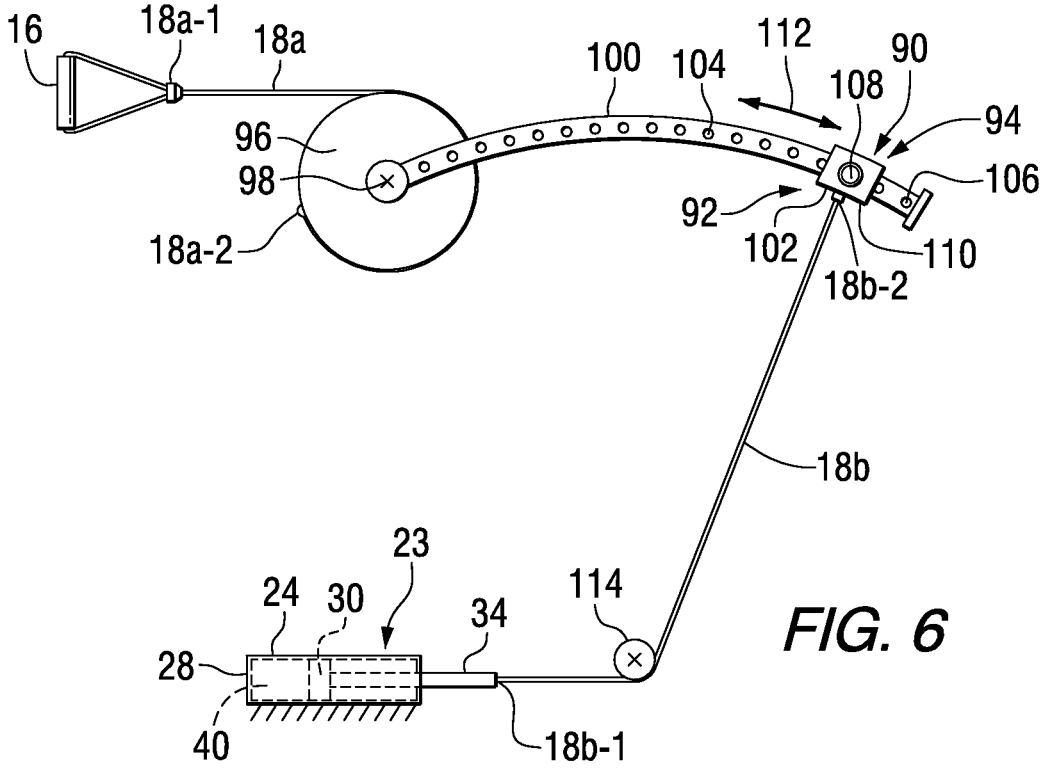
FIG. 6 is a schematic view illustrating an adjustment mechanism for a vacuum load system in accordance with the present disclosure.

Resistance training exercise apparatus 10, FIG. 1, includes load system 22 for providing resistance, comprising a vacuum load assembly 23, FIG. 6 comprising an axially extending tubular housing 24, FIGS. 2, 6, having inner cylinder wall 26 extending axially from axial end wall 28, and piston 30 in the housing and engaging cylinder wall 26 in sealing relation and axially slidable therealong. Connector link 34 extends from the vacuum load assembly and is coupled to user-engaged exercise member 16, FIGS. 1, 6. Piston 30 defines chamber 40 in the housing between piston 30 and end wall 28. Piston 30 is movable in a first axial direction (upwardly in FIGS. 1, 2; rightwardly in FIG. 6) away from end wall 28 to increase the volume of chamber 40, whereafter piston 30 is movable in a second opposite axial direction (downwardly in FIGS. 1, 2; leftwardly in FIG. 6) toward end wall 28 to decrease the volume of chamber 40. Movement of piston 30 in the noted first axial direction (upwardly in FIGS. 1, 2; rightwardly in FIG. 6) creates vacuum in chamber 40. This vacuum provides load resistance resisting movement of user-engaged exercise member 16, e.g. resisting downward and/or outward leftward movement of member 16 in FIGS. 1, 6.

The connector link includes an adjustment mechanism 90, FIG. 6, controlling effective vector force between the vacuum load assembly and user-engaged exercise member 16. The adjustment mechanism includes a user-controllable adjustment assembly 92 adjustably varying the vector force between the vacuum load assembly and user-engaged exercise member 16. The adjustment mechanism includes a gym cable 18*a* having a first end 18*a*-1 coupled to user-engaged exercise member 16, and having a distally opposite second end 18*a*-2. The adjustment mechanism includes a cylinder cable 18*b* having a first end 18*b*-1 coupled to the vacuum load assembly, and having a distally opposite second end 18*b*-2. Adjustment assembly 92 is coupled to at least one and preferably both of the noted second cable ends 18*a*-2, 18*b*-2. In one embodiment, the adjustment assembly extends between second end 18*a*-2 of the gym cable and second end 18*b*-2 of the cylinder cable, to be described, and the second end 18*a*-2 of the gym cable and the second end 18*b*-2 of the cylinder cable are spaced from each other at different locations along the adjustment assembly. The adjustment assembly includes a coupling mechanism 94 adjustably varying a lever arm distance of at least one of the gym cable second end and the cylinder cable second end along the adjustment assembly, to be described.

Figure 7:
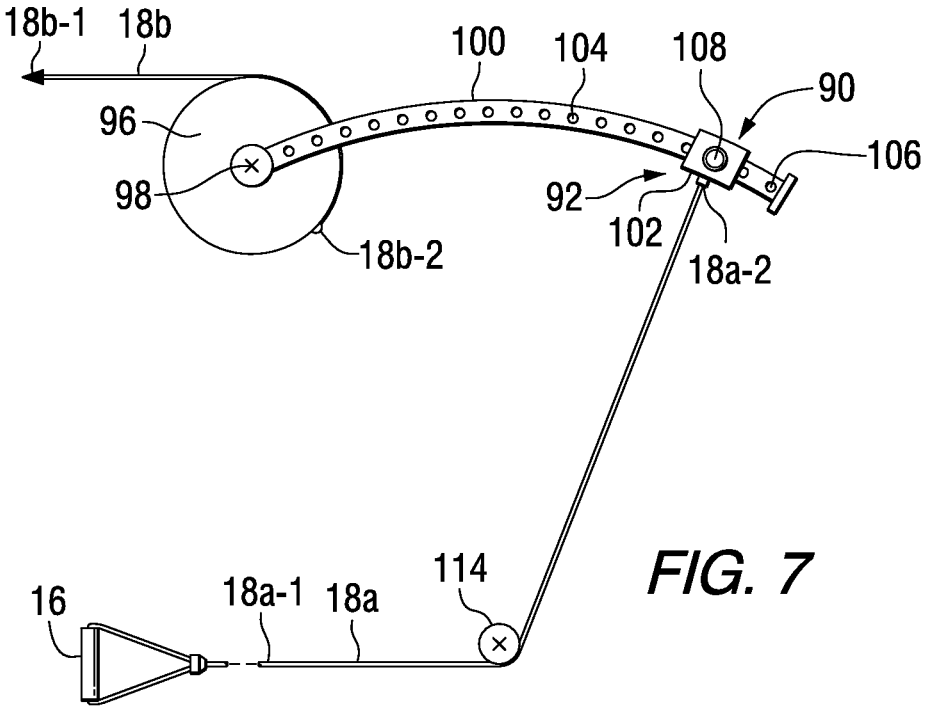
FIG. 7 is like FIG. 6 and shows another embodiment.

In the embodiment of FIG. 6, the adjustment assembly includes a cam 96 rotatable about a pivot axis 98, and a lever arm 100 extending from the cam. The coupling mechanism 94 includes an adjustable attachment member 102 connectable to lever arm 100 at a plurality of selectable locations 104, 106, etc. therealong spaced at differing distances from pivot axis 98. For example, lever arm 100 may have a plurality of apertures 104, 106, etc. receiving a user-engaged push-pull pin 108 in a sleeve or collar or coupler 110 slidable along lever arm 100 as shown at arrow 112, and lockable thereto when the user pushes pin 108 into a respective aperture such as 104, 106, etc. One of gym cable 18*a* and cylinder cable 18*b* is connected to cam 96, and the other of gym cable 18*a* and cylinder cable 18*b* is connected to adjustable attachment member 102. In the embodiment of FIG. 6, gym cable 18*a* is connected to cam 96, and cylinder cable 18*b* is connected to adjustment attachment member 102. In the embodiment of FIG. 7, cylinder cable 18*b* is connected to cam 96, and gym cable 18*a* is connected to adjustable attachment member 102. First end 18*b*-1 of the cylinder cable is coupled to the vacuum load assembly 23, as above, and first end 18*a*-1 of the gym cable is coupled to the user-engaged exercise member 16 as above.

In one embodiment, cam 96 is a pulley, and the respective one of the gym cable and the cylinder cable is trained around such pulley and connected thereto at the respective cable end 18*a*-2, 18*b*-2. In one embodiment, an alignment pulley 114 is provided, around which the respective gym cable 18*a*, FIG. 7, or cylinder cable 18*b*, FIG. 6, is trained between its respective first and second ends 18*a*-2 and 18*a*-1, or 18*b*-2 and 18*b*-1, such that the respective end 18*a*-1 or 18*b*-1 moves rectilinearly (left-right in FIGS. 6, 7). In these embodiments, the respective second cable end 18*a*-2 or 18*b*-2 moves in an arc about pivot axis 98.

Figure 8:
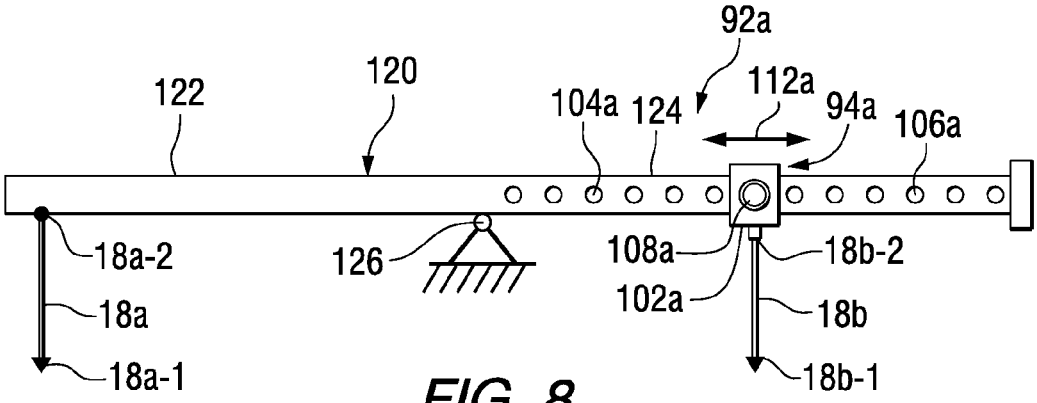
FIG. 8 is a schematic view illustrating a further embodiment.

In a further embodiment, adjustment assembly 92*a*, FIG. 8, includes a two-sided lever arm teeter-totter 120 having first and second sections 122 and 124 on distally opposite sides of a fulcrum 126. In one embodiment, gym cable 18*a* is connected to first section 122, and cylinder cable 18*b* is connected to second section 124. In another embodiment, cylinder cable 18*b* is connected to first section 122, and gym cable 18*a* is connected to second section 124. Coupling mechanism 94*a* includes adjustable attachment member 102*a* connectable to one of the first and second sections, e.g. second section 124, at a plurality of selectable locations 104*a*, 106*a*, etc. therealong, e.g. as provided by apertures as above, spaced at differing distances from fulcrum 126. In one embodiment, cylinder cable 18*b* is connected at its second end 18*b*-2 to adjustable attachment member 102*a*. In another embodiment, gym cable 18*a* at it second end 18*a*-2 is connected to adjustable attachment member 102*a*. In FIG. 8, adjustable attachment member 102*a* is connected to second section 124 of the two-sided lever arm teeter-totter 120, and cylinder cable 18*b* is connected to adjustable attachment member 102*a* at second cable end 18*b*-2. The first end 18*b*-1 of the cylinder cable is coupled to the vacuum load assembly 23, as above. In this embodiment, gym cable 18*a* is connected at its second end 18*a*-2 to first section 122 of two-sided lever arm teeter-totter 120. In this embodiment, first end 18*a*-1 of the gym cable is connected to the user-engaged exercise member 16, as above. Adjustable attachment member 102*a* may be provided by a sleeve or collar, as above, slidable along lever arm teeter-totter 120, as shown at arrow 112*a*, and lockable thereto by the user pushing in pin 108*a* into a respective aperture 104*a*, 106*a*, etc. In FIG. 8, cylinder cable 18*b* is connected to adjustable attachment member 102*a*, and gym cable 18*a* is connected to first section 122 at a fixed distance from fulcrum 126. In another embodiment, gym cable 18*a* is connected to adjustable attachment member 102*a*, and cylinder cable 18*b* is connected to section 122 at a fixed distance from fulcrum 126.

Figure 9:
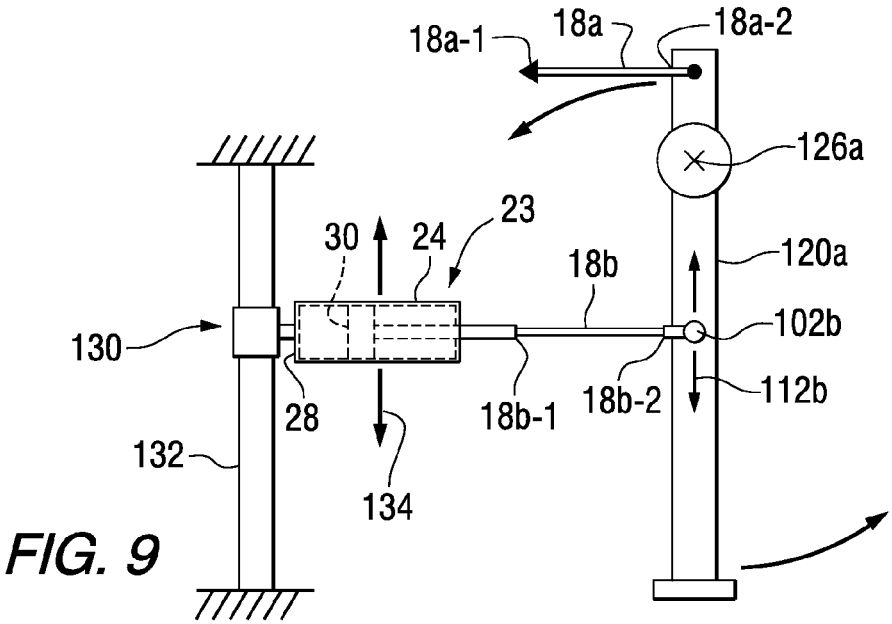
FIG. 9 is a schematic view illustrating a further embodiment.

In another embodiment, FIG. 9, first end 18*b*-1 of cylinder cable 18*b* is connected to piston 30, and an adjustable anchor assembly 130 is connected to housing 24. Adjustable anchor assembly 130 is slidable up-down in FIG. 9 along a stationary rod or frame 132 to move as shown at arrow 134 to differing selectable locations to concord with adjustment of adjustable attachment member 102*b* as shown at arrow 112*b* along two-sided lever arm teeter-totter 120*a* to a plurality of selectable locations spaced at differing distances from fulcrum 126*a*.

Figure 10:
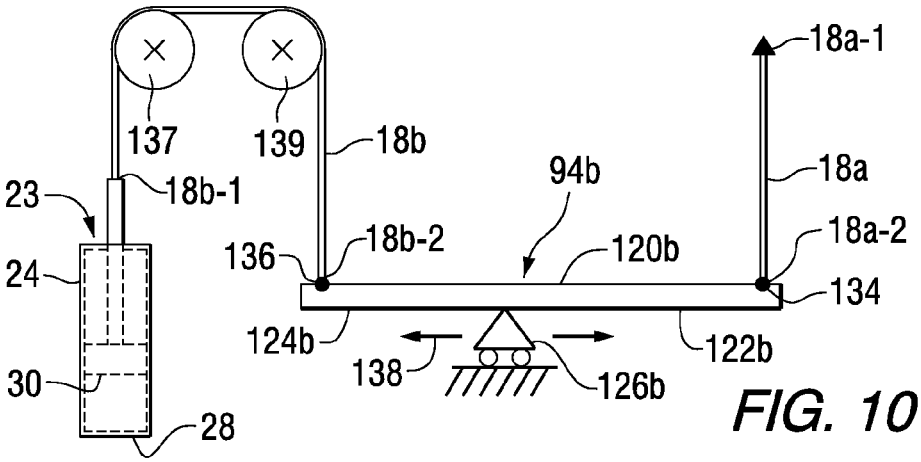
FIG. 10 is a schematic view illustrating a further embodiment.

In another embodiment, coupling mechanism 94*b*, FIG. 10, includes an adjustable fulcrum location 126*b* along two-sided lever arm teeter-totter 120*b* between gym cable 18*a* and cylinder cable 18*b*. Second end 18*a*-2 of gym cable 18*a* is connected to a first section 122*b* of two-sided lever arm teeter-totter 120*b* at a first fixed location 134, and second end 18*b*-2 of cylinder cable 18*b* is connected to a second section 124*b* of two-sided lever arm teeter-totter 120*b* at a second fixed location 136. First and second fixed locations 134 and 136 are on distally opposite sides of adjustable fulcrum location 126*b*, which may be varied left-right in FIG. 10 as shown at arrow 138. Cylinder cable 18*b* may be trained around alignment or guide pulleys such as 137, 139.

Figure 11:
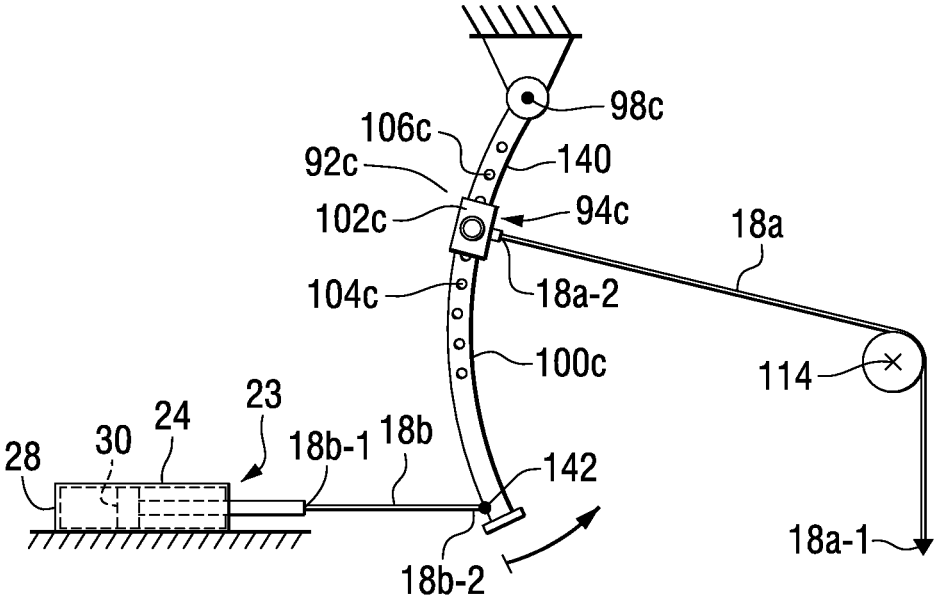
FIG. 11 is a schematic view illustrating a further embodiment.

In another embodiment, FIG. 11, adjustment assembly 92*c* includes a one-sided lever arm 100*c* rotatable about a pivot 98*c* and extending along an extension section 140 from pivot 98*c*. Gym cable 18*a* and cylinder cable 18*b* are connected to extension section 140 on the same side of pivot 98*c*. Coupling mechanism 94*c* includes adjustable attachment member 102*c* connectable to extension section 140 at a plurality of selectable locations 104*c*, 106*c*, etc., as above, spaced therealong at differing distances from pivot 98*c*. In the embodiment of FIG. 11, gym cable 18*a* at second cable end 18*a*-2 is connected to adjustable attachment member 102*c*, and gym cable 18*a* at first cable end 18*a*-1 is connected to user-engaged exercise member 16, as above. In this embodiment, cylinder cable 18*b* at second cable end 18*b*-2 is connected to extension section 140 at a fixed location 142 at a fixed distance from pivot 98*c*, and cylinder cable 18*b* at first cable end 18*b*-1 is connected to the vacuum load assembly 23, as above. Cylinder cable 18*b* at second cable end 18*b*-2 is spaced from pivot 98*c* by a distance greater than the spacing of gym cable 18*a* at second cable end 18*a*-2 from pivot 98*c*. In another embodiment, gym cable 18*a* at second cable end 18*a*-2 is spaced from pivot 98*c* by a distance greater than the spacing of cylinder cable 18*b* at second cable end 18*b*-2 from pivot 98*c*. In another embodiment, cylinder cable 18*b* at second cable end 18*b*-2 is connected to adjustable attachment member 102*c*, and gym cable 18*a* at second cable end 18*a*-2 is connected to extension section 140 at a fixed location at a fixed distance from pivot 98*c*.

Figure 12:
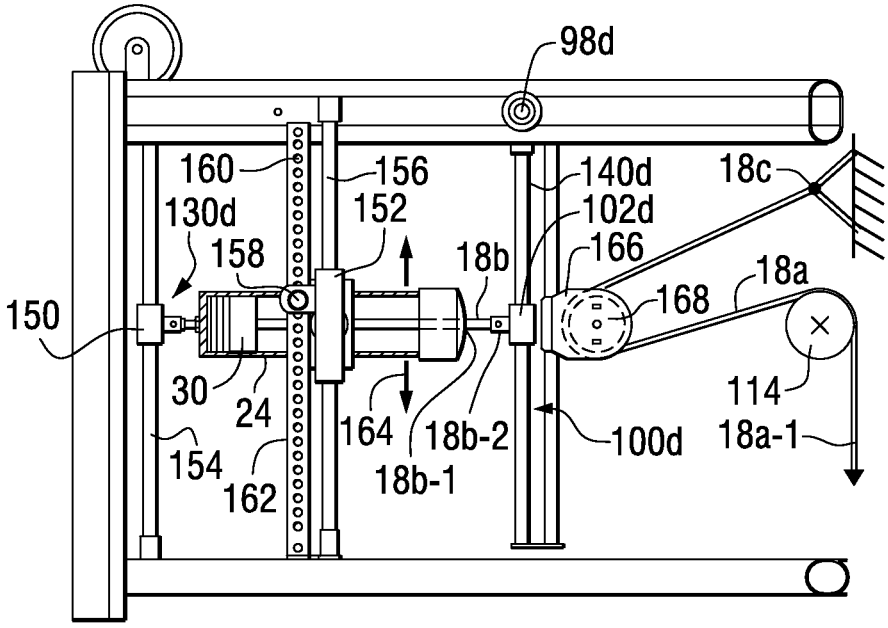
FIG. 12 is a schematic view illustrating a further embodiment.

In another embodiment, FIG. 12, second end 18*b*-2 of cylinder cable 18*b*, which may be flexible or may be a rigid rod cable, is connected to adjustable attachment member 102*d*, and first end 18*b*-1 of the cylinder cable is connected to piston 30. Adjustable anchor assembly 130*d* is connected to housing 24 at a pair of sleeves or collars 150, 152 slidable up-down in FIG. 12 along respective stationary rods or frames 154, 156, and lockable in position at a locking member such as push-pull pin 15R pushed by the user into a respective aperture 160 along vertical rail 162. Adjustable anchor assembly 130*d* is movable to move the vacuum load assembly up-down in FIG. 12 as shown at arrow 164 to concord with adjustment of adjustable attachment member 102*d* along extension section 140*d* of one-sided lever arm 100*d* to a plurality of selectable locations spaced at differing distances from pivot 98*d*. Cylinder cable 18*a* may be coupled to one-sided lever arm 100*d* at a variable location therealong at sleeve or collar 166. In one version, the location of one or both members 102*d* and 166 are chosen by sliding the respective member up-down along one-sided lever arm 100*d* and then fixing the member to one-sided lever arm 100*d* at such selected location. In a further embodiment, sleeve or collar 166 may include a pulley 168 around which gym cable 18*a* is trained and then anchored at end 18*c*.

Figure 13:
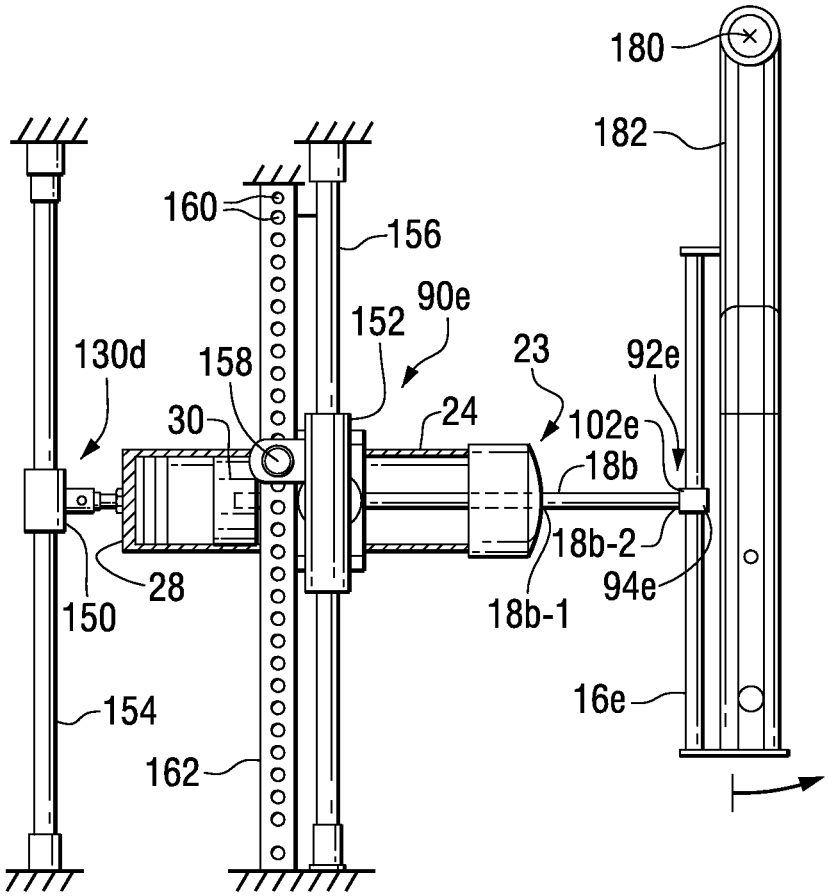
FIG. 13 is a schematic view illustrating a further embodiment.

In a further embodiment, FIG. 13, adjustment mechanism 90*e* includes cylinder cable 18*b*, which may be flexible or a fixed rod cable, having a first end 18*b*-1 connected to the vacuum load assembly 23, and a distally opposite second end 18*b*-2. User-engaged exercise member 16*e*, rather than a handle as at 16 in FIG. 6, is instead rotatable about a pivot 180 and has an extension arm 182 extending from pivot 180. Adjustment assembly 92*e* includes coupling mechanism 94*e* adjustably varying a lever arm distance of cylinder cable second end 18*b*-2 along extension arm 182. Coupling mechanism 94*e* includes adjustable attachment member 102*e* as above connectable to extension arm 182 at a plurality of selectable locations therealong, e.g. up-down in FIG. 13, at differing distances from pivot 180. Cylinder cable second end 18*b*-2 is connected to adjustable attachment member 102*e*. First end 18*b*-1 of cylinder cable 18*b* is connected to piston 30, and adjustable anchor assembly 130*d* is provided as above and connected to housing 24 and movable to differing selectable locations, e.g. up-down in FIG. 13, to concord with adjustment of adjustable attachment member 102*e* along extension arm 182 to the plurality of selectable locations spaced at differing distances from pivot 180.

Figure 14:
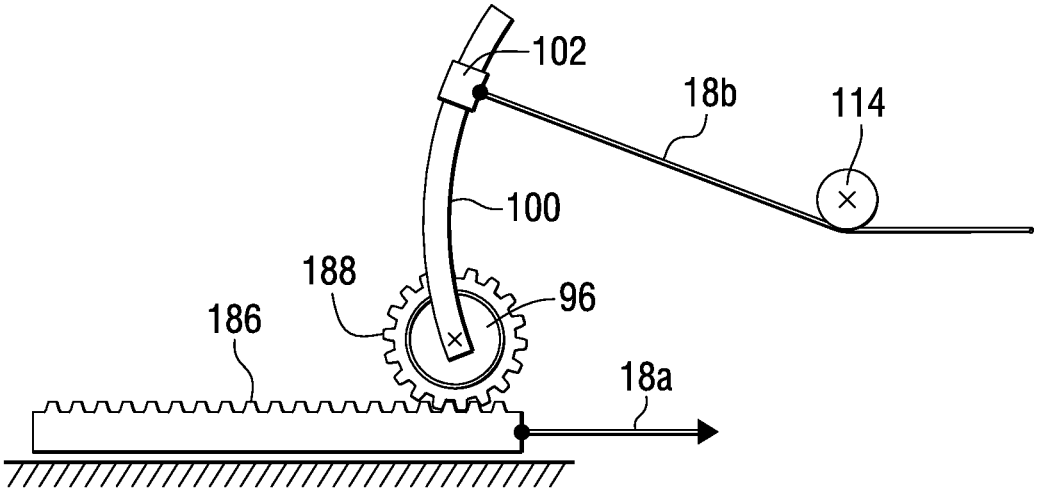
FIG. 14 is a schematic view illustrating a further embodiment.

In another embodiment, FIG. 14, one of the gym cable and cylinder cable, e.g. gym cable 18*a*, is connected to cam 96 through a rack and pinion assembly 186 and 188.

In various embodiments, the gym cable and the cylinder cable can be reversed, including as noted above. In further embodiments, the cylinder cable first end 18*b*-1 may be coupled to the piston 30, with the housing 24 being held stationary, or alternatively may be coupled to the housing 24, with the piston 30 being held stationary.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. Resistance training exercise apparatus comprising a load system for providing resistance comprising a vacuum load assembly comprising an axially extending tubular housing having an inner cylinder wall extending axially from an axial end wall, a piston in said housing and engaging said cylinder wall in sealing relation and axially slidable therealong, a connector link extending from said vacuum load assembly and coupled to a user-engaged exercise member, said piston defining a chamber in said housing between said piston and said end wall, said piston moving in a first axial direction away from said end wall to increase the volume of said chamber, said piston moving in a second opposite axial direction toward said end wall to decrease the volume of said chamber, wherein movement of said piston in said first axial direction creates vacuum in said chamber, which vacuum provides load resistance resisting exercise movement of said user-engaged exercise member, said connector link comprising an adjustment mechanism controlling effective vector force between said vacuum load assembly and said user-engaged exercise member;

wherein said adjustment mechanism includes a user-controllable adjustment assembly adjustably varying said vector force between said vacuum load assembly and said user-engaged exercise member;

wherein said adjustment mechanism comprises a gym cable having a first end coupled to said user-engaged exercise member, and having a distally opposite second end, and a cylinder cable having a first end coupled to said vacuum load assembly, and having a distally opposite second end.

2. The resistance training exercise apparatus according to claim 1 wherein said adjustment mechanism comprises an adjustment assembly coupled to at least one of said second end of said gym cable and said second end of said cylinder cable.

3. The resistance training exercise apparatus according to claim 2 wherein said adjustment assembly extends between said second end of said gym cable and said second end of said cylinder cable, and wherein said second end of said gym cable and said second end of said cylinder cable are spaced from each other at different locations along said adjustment assembly.

4. The resistance training exercise apparatus according to claim 2 wherein said adjustment assembly comprises a coupling mechanism adjustably varying a lever arm distance of at least one of said gym cable second end and said cylinder cable second end along said adjustment assembly.

5. The resistance training exercise apparatus according to claim 4 wherein said adjustment assembly comprises a cam rotatable about a pivot axis, and a lever arm extending from said cam, said coupling mechanism comprising an adjustable attachment member connectable to said lever arm at a plurality of selectable locations therealong spaced at differing distances from said pivot axis, wherein one of said gym cable and said cylinder cable is connected to said cam, and the other of said gym cable and said cylinder cable is connected to said adjustable attachment member.

6. The resistance training exercise apparatus according to claim 5 wherein said gym cable is connected to said cam, and said cylinder cable is connected to said adjustable attachment member.

7. The resistance training exercise apparatus according to claim 5 wherein said cam is a pulley, and said one of said gym cable and said cylinder cable is trained around said pulley.

8. The resistance training exercise apparatus according to claim 5 comprising an alignment pulley around which said other of said gym cable and said cylinder cable is trained between said first and second ends such that said first end moves rectilinearly, and second end moves in an arc about said pivot axis.

9. The resistance training exercise apparatus according to claim 5 wherein said cylinder cable is connected to said cam, and said gym cable is connected to said adjustable attachment member.

10. The resistance training exercise apparatus according to claim 4 wherein said adjustment assembly comprises a two-sided lever arm teeter-totter having first and second sections on distally opposite sides of a fulcrum, said gym cable being connected to said first section, said cylinder cable being connected to said second section.

11. The resistance training exercise apparatus according to claim 10 wherein said coupling mechanism comprises an adjustable attachment member connectable to one of said first and second sections at a plurality of selectable locations therealong spaced at differing distances from said fulcrum, wherein one of said gym cable and said cylinder cable is connected to said adjustable attachment member.

12. The resistance training exercise apparatus according to claim 11 wherein said adjustable attachment member is connected to said second section, and said cylinder cable is connected to said adjustable attachment member.

13. The resistance training exercise apparatus according to claim 12 wherein said gym cable is connected to said first section at a fixed distance from said fulcrum.

14. The resistance training exercise apparatus according to claim 11 wherein said adjustable attachment member is connected to said first section, and said gym cable is connected to said adjustable attachment member.

15. The resistance training exercise apparatus according to claim 14 wherein said cylinder cable is connected to said second section at a fixed distance from said fulcrum.

16. The resistance training exercise apparatus according to claim 12 wherein said first end of said cylinder cable is connected to one of said piston and said housing, and comprising an adjustable anchor assembly connected to the other of said piston and said housing and movable to differing selectable locations to concord with adjustment of said adjustable attachment member along said two-sided lever arm teeter-totter to said plurality of selectable locations spaced at differing distances from said fulcrum.

17. The resistance training exercise apparatus according to claim 10 wherein said coupling mechanism comprises an adjustable fulcrum location of said fulcrum along said two-sided lever arm teeter-totter between said gym cable and said cylinder cable.

18. The resistance training exercise apparatus according to claim 17 wherein said second end of said gym cable is connected to said first section of said two-sided lever arm teeter-totter at a first fixed location, said second end of said cylinder cable is connected to said second section of said two-sided lever arm teeter-totter at a second fixed location, and said first and second fixed locations are on distally opposite sides of said adjustable fulcrum location.

19. The resistance training exercise apparatus according to claim 4 wherein said adjustment assembly comprises a one-sided lever arm rotatable about a pivot and extending along an extension section from said pivot, each of said gym cable and said cylinder cable being connected to said extension section on the same side of said pivot.

20. The resistance training exercise apparatus according to claim 19 wherein said coupling mechanism comprises an adjustable attachment member connectable to said extension section at a plurality of selectable locations therealong spaced at differing distances from said pivot, wherein one of said gym cable and said cylinder cable is connected to said adjustable attachment member.

21. The resistance training exercise apparatus according to claim 20 wherein the other of said gym cable and said cylinder cable is connected to said extension section at a fixed location at a fixed distance from said pivot.

22. The resistance training exercise apparatus according to claim 20 wherein the other of said gym cable and said cylinder cable is spaced from said pivot by a distance greater than the spacing of said one of said gym cable and said cylinder cable from said pivot.

23. The resistance training exercise apparatus according to claim 20 wherein said second end of said cylinder cable is connected to said adjustable attachment member, and said first end of said cylinder cable is connected to one of said piston and said housing, and comprising an adjustable anchor assembly connected to the other of said piston and said housing and movable to differing selectable locations to concord with adjustment of said adjustable attachment member along said extension section of said one-sided lever arm to said plurality of selectable locations spaced at differing distances from said pivot.

24. The resistance training exercise apparatus according to claim 1 wherein said user-engaged exercise member is rotatable about a pivot and has an extension arm extending from said pivot, and said adjustment assembly comprises a coupling mechanism adjustably varying a lever arm distance of said cylinder cable second end along said extension arm.

25. The resistance training exercise apparatus according to claim 24 wherein said coupling mechanism comprises an adjustable attachment member connectable to said extension arm at a plurality of selectable locations therealong spaced at differing distances from said pivot, wherein said cylinder cable second end is connected to said adjustable attachment member.

26. The resistance training exercise apparatus according to claim 25 wherein said first end of said cylinder cable is connected to one of said piston and said housing, and comprising an adjustable anchor assembly connected to the other of said piston and said housing and movable to differing selectable locations to concord with adjustment of said adjustable attachment member along said extension arm to said plurality of selectable locations spaced at differing distances from said pivot.

27. The resistance training exercise apparatus according to claim 1 wherein said adjustment mechanism comprises an adjustment assembly coupled to at least one of said second end of said gym cable and said second end of said cylinder cable, wherein said adjustment assembly comprises a coupling mechanism adjustably varying a lever arm distance of at least one of said gym cable second end and said cylinder cable second end along said adjustment assembly, wherein said adjustment assembly comprises a cam rotatable about a pivot axis, and a lever arm extending from said cam, said coupling mechanism comprising an adjustable attachment member connectable to said lever arm at a plurality of selectable locations therealong spaced at differing distances from said pivot axis, wherein one of said gym cable and said cylinder cable is connected to said adjustable attachment member, and the other of said gym cable and said cylinder cable is connected to said cam through a rack and pinion assembly.

* * * * *